United States Patent [19]

Konert

[11] Patent Number: 5,051,064

[45] Date of Patent: Sep. 24, 1991

[54] LIGHTWEIGHT GAS CASING

[75] Inventor: Bernd Konert, Bad Säckingen, Fed. Rep. of Germany

[73] Assignee: Compres AG, Baden, Switzerland

[21] Appl. No.: 460,664

[22] Filed: Jan. 3, 1990

[30] Foreign Application Priority Data

Jan. 26, 1989 [CH] Switzerland ..... 250/89

[51] Int. Cl.[5] ..... F04F 11; F02B 33/00; F02C 3/02

[52] U.S. Cl. ..... 417/64; 60/39.45; 60/612; 123/559.2

[58] Field of Search ..... 417/64; 60/39.45, 612; 123/559.2

[56] References Cited

U.S. PATENT DOCUMENTS

| | | | |
|---|---|---|---|
| 2,759,660 | 8/1956 | Jendrassik | 417/64 |
| 2,952,986 | 9/1960 | Spalding | 417/64 |
| 3,209,986 | 10/1965 | Kentfield | 417/64 |
| 3,450,334 | 6/1969 | Brown | 417/64 |

FOREIGN PATENT DOCUMENTS

| | | | |
|---|---|---|---|
| 2261420 | 9/1975 | France . | |
| 0437078 | 10/1935 | United Kingdom | 60/612 |

*Primary Examiner*—Leonard E. Smith
*Assistant Examiner*—Alfred Basichas
*Attorney, Agent, or Firm*—Burns, Doane, Swecker & Mathis

[57] ABSTRACT

The main parts of the lightweight gas casing are a rigid force-absorbing part (1) consisting of metal plates (2, 3) which can be worked without cutting, have flanges (4, 5, 6) for connecting the casing to fluid-conducting engine parts and are rigidly connected to one another, for example by welding. The channels (12, 16) are sheet metal pressed parts which connect to one another the through-holes (9, 11; 14, 15) in the flanges (4,5, 6), which form the inlet and outlet cross-sections of the fluids, and are welded by their ends to these through-holes.

4 Claims, 2 Drawing Sheets

LIGHTWEIGHT GAS CASING

BACKGROUND OF THE INVENTION

The present invention relates to a lightweight gas casing having channels for conducting gaseous or liquid media and having flanges for connecting lines for the feeding and removal of these media into and out of the casing.

FIELD OF THE INVENTION AND DISCUSSION OF BACKGROUND

Casings according to the present invention are preferably components of heat engines in which a hot gas is supplied as the working medium and is discharged as expanded exit gas. Such casings have, in the immediate vicinity of one another, channels for the entering hot gas at high temperature and channels for the discharging exit gas, which has cooled down after performing its work, at a lower temperature. Due to of the greater specific volume of the exit gas in relation to the hot gas, the channel cross-section of the exit gas is correspondingly larger Therefore, in such a casing there are, next to one another, channels of different cross-section, through which gases at different temperatures and various pressures flow, which results in heat expansion of varying degrees in the channel walls, in any webs which are present, in material accumulations, which can practically scarcely be avoided with cast parts, and also in the securing flanges The casting materials used for such casings have relatively low elongations at break so that, as a consequence of large thermal expansions, there is a danger of expansion cracks. If it is particularly important to have tight flange connections and, for reasons of cost, the outlay on them must not be excessive, use having to be made instead of conventional thin flat seals exclusively, flanges which are in danger of distorting cannot be used for a secure seal. Gas would escape, efficiency of the engine would be impaired and the leakage gas could also have harmful effects on health.

SUMMARY OF THE INVENTION

Accordingly, in order to avoid the disadvantages indicated above, the object of the invention is to find as a replacement for the cast design of such gas casings a type of construction which not only avoids these disadvantages but is also more suitable and more economical for mass production than a cast design. Furthermore, this type of construction is also to entail an expansion of the range of materials which are suitable for gas casings subjected to high temperatures, that is to say that, in addition to the relatively small number of castable high temperature resistant materials, the much larger range of rolled semi-finished products which can be worked without cutting by stamping, punching etc, in particular in the form of sheets, comes into consideration for such gas casings.

Such a type of construction should also permit, in addition to an expensive material for the parts which are subjected to high temperatures, use of less expensive material for the parts which are not subjected so much to heat, which preferably applies to the solid flange parts. As a result of its high elongation at break, the more expensive heat-resistant material also withstands greater deformations due to heat without any fear of cracking. The disadvantage of its higher price is usually at least compensated for by the fact that the channel walls can be substantially thinner than in cast pieces.

The same applies to the cheaper materials which are suitable for the more solid flange parts, in respect of the elongation at break and deformation behavior, as to the materials of the gas-conducting channels However, from the advantages in terms of materials of a welded construction comprising of thin-walled, shell-shaped pressed parts, there also results a disadvantage, that of diminished stability compared with cast designs. This is significant if forces, for example caused by vibrations, are to be passed on by the casing of the apparatus exposed to hot gas, for example to the gas feed and discharge lines which are connected to flanges of the channels mentioned at the beginning for the hot untreated gas and the expanded exit gas. The vibrations, reinforced by the thermal stress which also fatigues the material, can result in ruptures in the channel walls. Therefore, it is an object of the invention to protect the thin-walled gas-conducting channels from the destructive effect of vibrations by design measures. These measures consist in dividing up the structure of the casing into a gas-conducting part and into a force-absorbing part.

The lightweight gas casing according to the invention is defined by the fact that the said flanges are rigidly connected to one another and form a force-absorbing part of the casing, by the fact that the channels are constructed as sheet metal pressed parts and by the fact that the end cross-sections of these channels conductively connect through-holes in at least one of the flanges to through-holes in at least one of the other flanges, which through-holes are the inlet and outlet cross-sections of the media and at which the ends of the channels are welded to the flanges.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
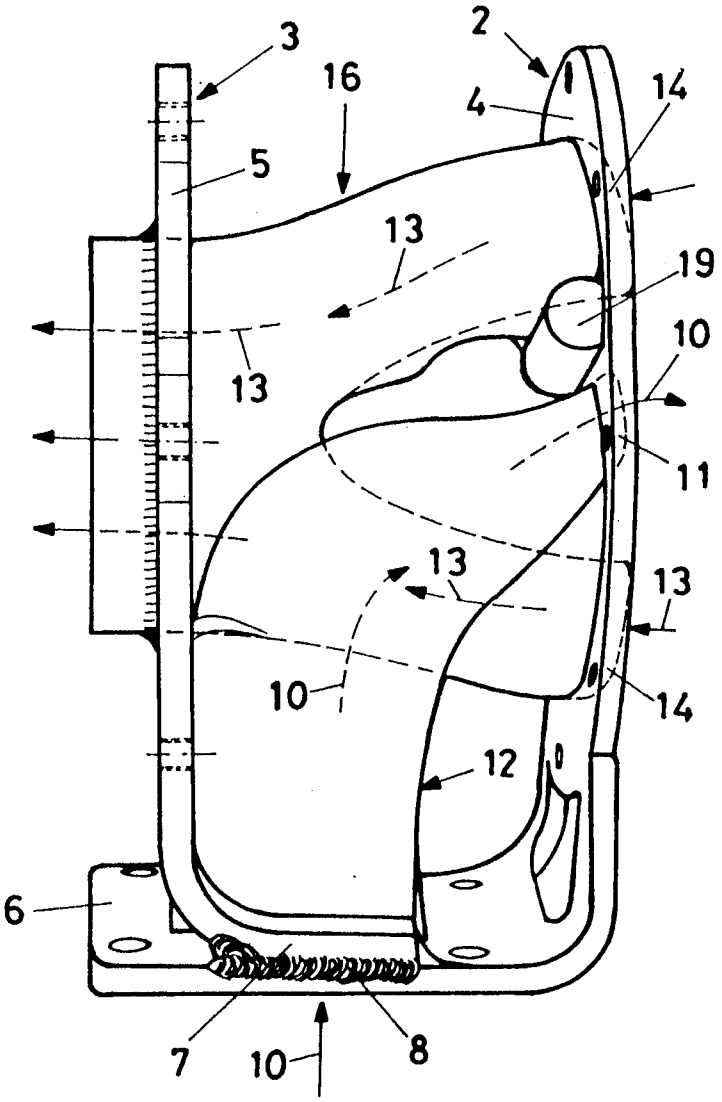
FIGS. 2 and 3 show the gas casing in side elevations essentially associated with FIG. 1 and indicating the paths of the gas channels, in positions somewhat tilted forwards or backwards and to the side.

The exemplary embodiment represented is the gas casing of a pressure-wave supercharger for internal combustion engines. It receives the exit gases of the engine in two inlet channels, which exit gases compress the combustion air in a cell rotor and flow out, expanded and cooled, through two outlet channels into the exhaust system. In a design as a cast piece, the channels have joint limiting walls, the two sides of which are exposed to gas at different temperatures with the danger mentioned at the beginning of distortion of the entire casing by thermal stresses, which can also result in cracks. Apart from this, production by casting is costly due to the complicated paths of the channels and also very expensive in terms of material, since the entire casing body consists of one and the same very expensive material, whereas according to the invention a less expensive material is sufficient for the parts which are subjected to lower temperatures, Referring now to the drawings, wherein like reference numerals designate identical or corresponding parts throughout the several views, 1 designates the force-absorbing part of the casing, part which consists of two flange plates 2 and 3 of sheet metal which can be worked without cutting and having limbs which are in each case at right angles to one another. The larger limbs, in each case standing up vertically and essentially parallel to one another, in the figures form flanges 4 and 5, of which the one, 4, serves for the connection to the rotor casing and the other, 5, receives the outlet part of an exhaust port, which will be described in greater detail below, and serves as the connecting flange for the exhaust system of the engine.

Figure 3:
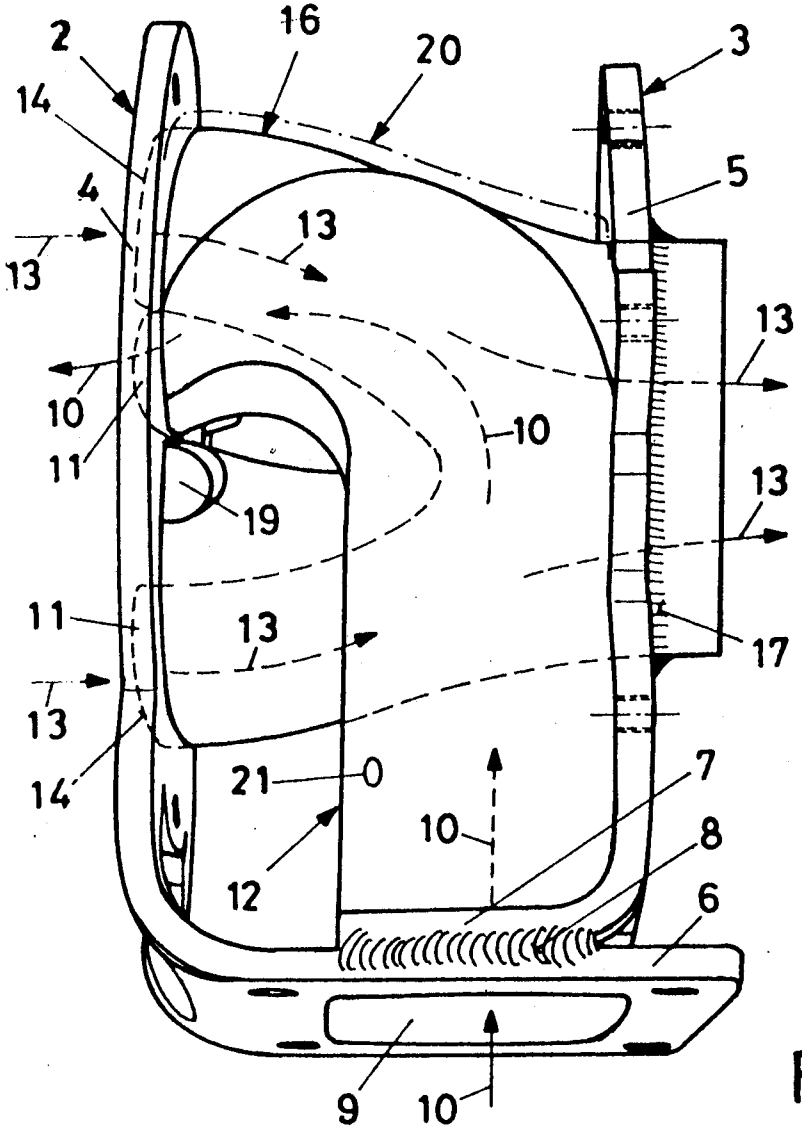
Figure 4:
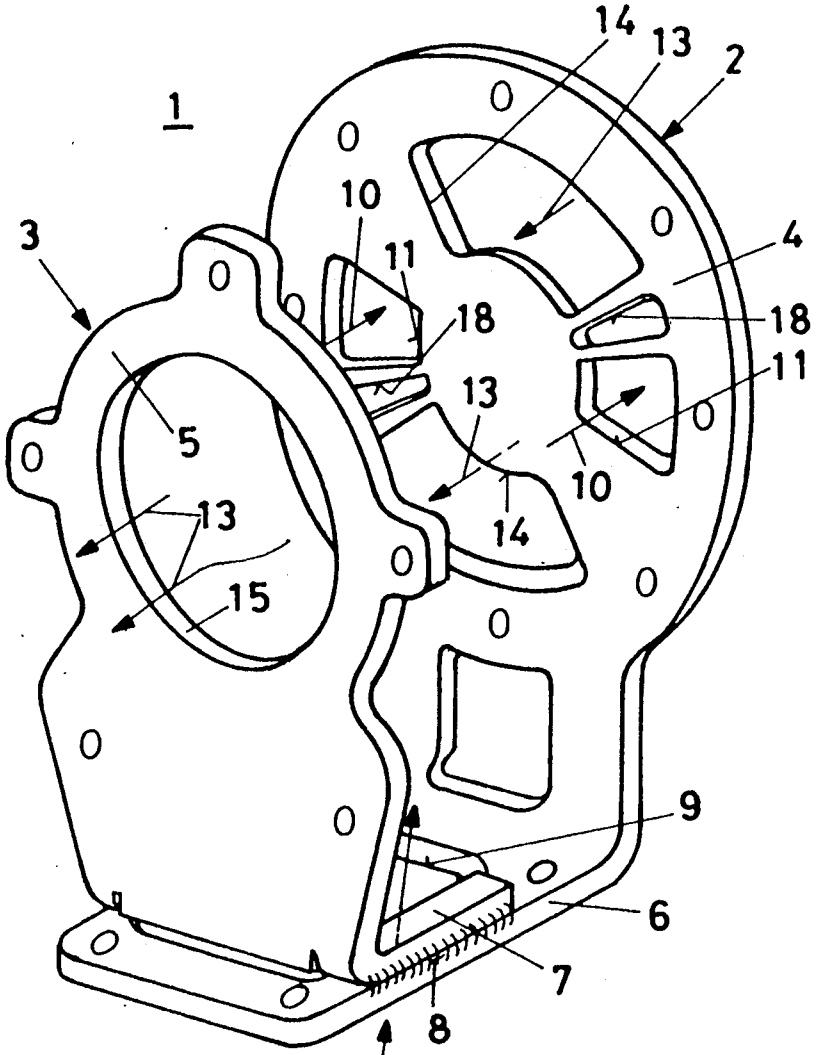
FIG. 4 shows an axonometric representation of the force-absorbing part of the casing structure.

The two other, shorter limbs 6 and 7 of the flange plates 2 and 3 lie on top of one another in the manner shown in FIGS. 2, 3 and 4 and are connected to one another along their parallel side edges by weld seams 8. The limb 6 has an essentially rectangular through-hole 9, see FIGS. 3 and 4, while the limb 7 consists of two rod-shaped parts which laterally limit the through-hole 9.

Figure 1:
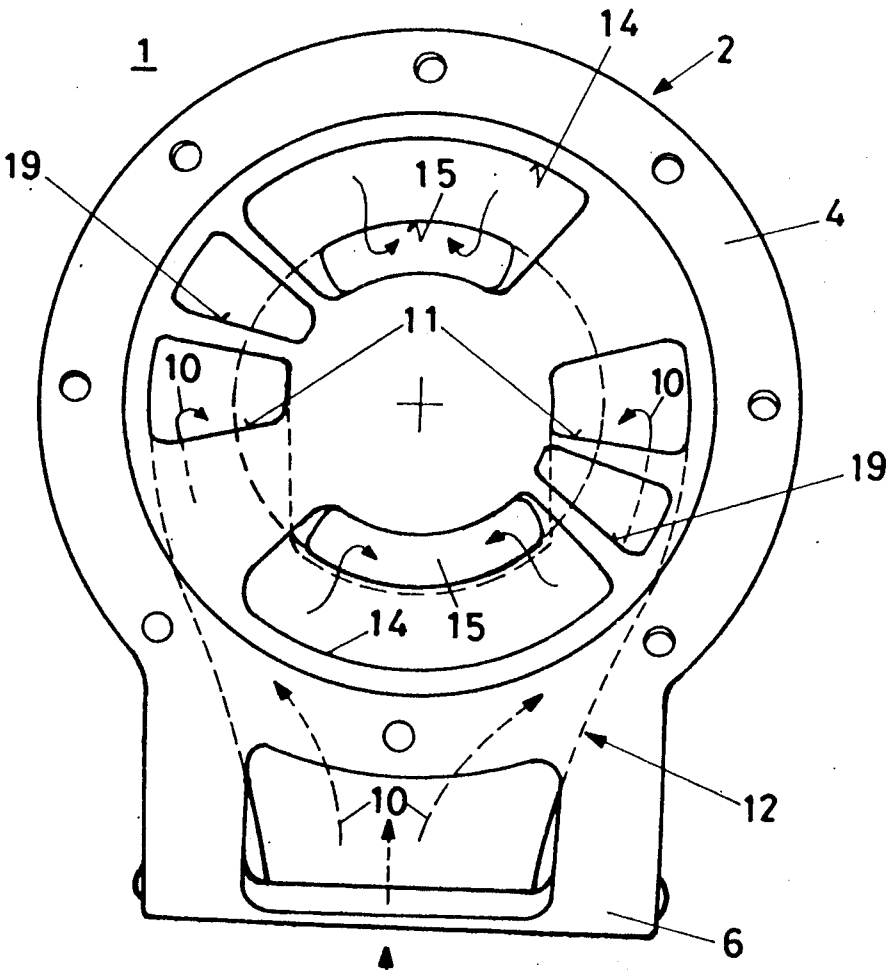
FIG. 1 shows an elevation of a gas casing according to the invention.

At the through-hole 9 of the shorter limb 6 of the flange plate 2, the hot exit gas coming out of the engine enters the casing, as indicated by the flow arrows 10. The short limb 6 thus forms a flange for the connection of an exhaust pipe, not shown, coming from the engine and is therefore referred to below as exhaust flange In the flange 4 there are two dyametrically opposite through-holes 11 through which the hot exit gas entering at 9 leaves the casing and enters the cell rotor, not shown, of the pressure-wave supercharger. The shape of the hot gas channel 12, which connects the through-hole 9 to the through-holes 11, can be seen in FIGS. 1, 2 and 3. Starting at the rectangular cross-section at the through-hole 9, where it is welded at its periphery to the lower side of the exhaust flange 6, it broadens towards the top and splits into two branches, which are welded to the flange 4 at the periphery of its through-holes 11.

The gas which is expanded and cooled in the cell rotor, referred to below as exit gas, passes, as indicated by the flow arrows 13, through the two diametrically opposite through-holes 14, in the flange 4 into the casing and leaves it in the region of an orbicular through-hole 15 in the flange 5, from where it flows on into an exhaust system not shown The associated exhaust port 16 starts with two branches at the two through-holes 14 of the flange 4 which unite downstream and merge with an orbicular connecting piece, which passes through the through-hole 15 in the flange 5 and is connected to the latter by a weld seam 17.

The hot gas channel 12 and the exhaust port 16 have no walls in common and are therefore independent of one another in terms of heat expansion. Since the elongation at break of the metal sheets which can be worked without cutting is greater than is customary with casting materials, cracks, as can occur in casting pieces due to their irregular wall thicknesses, are not to be expected in designs according to the invention.

In addition to the two channels 12 and 16 described, if necessary further channels could of course be provided between the flanges of the other elements of the force-absorbing part. In the present case, the two small through-holes 18, which can be seen in FIG. 4, are covered by elongate sheet metal cups which are welded on and limit so-called "pockets" 19 on the free flange plane facing the rotor of the pressure-wave supercharger, which pockets are important for a satisfactory pressure-wave process, see FIGS. 1, 2 and 3.

The channels, which look complicated at first sight, for the hot gas and the exhaust gas are nevertheless cheaper to manufacture in series production than cast pieces. The channels consist of deep-drawn half-shells welded to one another, the dividing lines being provided along their axes of symmetry or along suitable contact lines of tangent planes or enveloping surfaces. Even undercuts, if unavoidable, can be handled in terms of manufacturing engineering The welds can be performed by robot. The weight saving is quite considerable compared with cast pieces, which means lower costs, which can be reduced even further for a casing with channels which are subjected to different temperatures, if for each channel the particular grade of material adequate for it is chosen. Channels which are subjected to less stress can thus be pressed from cheaper material. Due to the free and mutually independent workability of the channels, different material properties, for example coefficients of thermal expansion, have no effect on durability.

This type of casing construction is of course advantageous not only for thermally stressed engines but also represents an economical alternative to castings for other applications, for example for liquids and cold gases.

If it is important to keep heat losses from the hot gas channels as low as possible, it is expedient to provide an insulating jacket 20 secured sealingly by its edges to the flanges, the contour of which jacket is indicated by dot-dash lines in FIG. 3 and which seals off all or only the hot gas channels from the outside. The latter are thermally insulated even better if the space surrounding the channels, but in particular the hot gas channels, and enclosed by the insulating jacket is connected conductively via a bore 21, see FIG. 3, in the hot gas channels 12 to the latter and is thus surrounded by hot gas. The insulating jacket also reduces the emission of noise from the channels Still better muffling is obtained by filling the said space with a noise-deadening and heat-insulating material.

Obviously, numerous modifications and variations of the present invention are possible in light of the above teaching It is therefore to be understood that, within the scope of the appended claims, the invention may be practiced otherwise than as specifically described herein.

What is claimed as new and desired to be secured by Letters patent of the United States is:

1. A lightweight gas casing of a pressure-wave supercharger, having a rotor casing flange for connecting the gas casing to a rotor casing of the pressure-wave supercharger, an exit gas flange for connecting the gas casing to an exit gas line of an internal combustion engine and an exhaust gas flange for connecting the gas casing to an exhaust line, each of said flanges being rigidly connected to one another to form a force-absorbing part of the gas casing, said rotor casing flange and said exit gas flange forming two limbs of a first flange plate, said two limbs being at right angles to one another, said exhaust gas flange forming part of a second flange plate, said second flange plate having two rod-shaped limbs at right angles to the exhaust gas flange, wherein the second flange plate is welded along the outer edges of said rod-shaped limbs to two side edges of the exit gas flange, said gas casing further including a hot gas channel for feeding exit gas from said engine into a rotor of the pressure-wave supercharger and an exhaust gas channel for moving the expanded and cooled exit gas from the rotor into the exhaust line, said channels being constructed as sheet metal pressed parts, said hot gas channel and said exhaust gas channel each being welded together out of two deep-drawn half-shells, said hot gas channel being welded at one end to said exit gas flange and at an opposite end to said rotor casing flange, said exhaust gas channel being welded at one end to said exhaust flange and at an opposite end to said rotor casing flange, said hot gas channel being split into two branches starting at a one-piece through-hole in said exit gas flange and ending in two through-holes in the rotor casing flange, said exhaust gas channel being split into two branches starting at a one-piece through-hole in said exhaust gas flange and ending in two through-holes in the rotor casing flange.

2. Lightweight gas casing as claimed in claim 1, which comprises an insulating jacket which encapsulates at least said hot gas conducting channel and is secured sealingly by its edges to the exit gas flange, the exhaust gas flange and the rotor casing flange.

3. Lightweight gas casing as claimed in claim 2, wherein the two branches of said hot gas channel communicate via a bore with the space enclosed by the insulating jacket.

4. Lightweight gas casing as claimed in claim 2, wherein the space limited by the insulating jacket, the exit gas flange, the exhaust gas flange the rotor casing flange, the hot gas channel and the exhaust gas channel is filled with a noise-deadening and heat-insulating material.

* * * * *

UNITED STATES PATENT AND TRADEMARK OFFICE

CERTIFICATE OF CORRECTION

PATENT NO. : 5,051,064

DATED : September 24, 1991

INVENTOR(S) : Bernd Konert

It is certified that error appears in the above-identified patent and that said Letters Patent is hereby corrected as shown below:

Title page, Assignee should read;
[73] Assignee: Comprex AG, Baden, Switzerland

Signed and Sealed this

Sixteenth Day of February, 1993

*Attest:*

STEPHEN G. KUNIN

*Attesting Officer*

*Acting Commissioner of Patents and Trademarks*